US009922638B2

(12) United States Patent
Calvo et al.

(10) Patent No.: US 9,922,638 B2
(45) Date of Patent: Mar. 20, 2018

(54) ACOUSTIC FRESNEL ZONE PLATE LENS FOR AQUEOUS ENVIRONMENTS AND METHODS OF USING SAME

(71) Applicants: David C. Calvo, Alexandria, VA (US); Abel L. Thangawng, Alexandria, MD (US)

(72) Inventors: David C. Calvo, Alexandria, VA (US); Abel L. Thangawng, Alexandria, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 285 days.

(21) Appl. No.: 14/926,055

(22) Filed: Oct. 29, 2015

(65) Prior Publication Data

US 2016/0125870 A1 May 5, 2016

Related U.S. Application Data

(60) Provisional application No. 62/069,895, filed on Oct. 29, 2014.

(51) Int. Cl.
*G10K 11/30* (2006.01)

(52) U.S. Cl.
CPC ..... *G10K 11/30* (2013.01); *G10K 2200/11* (2013.01)

(58) Field of Classification Search
USPC ..... 367/138
See application file for complete search history.

(56) References Cited

U.S. PATENT DOCUMENTS 3,585,847 A * 6/1971 Brenden ..... A61B 8/0825 359/900
3,765,403 A * 10/1973 Brenden ..... A61B 8/0825 128/915

(Continued)

FOREIGN PATENT DOCUMENTS

DE 3040635 A1 * 5/1982 ..... G10K 11/30

OTHER PUBLICATIONS

WO 2016/070200 A1. David Calvo. International Search Report and Written Opinion. dated May 6, 2016.*

(Continued)

*Primary Examiner* — Isam A Alsomiri
*Assistant Examiner* — Jonathan D Armstrong
(74) *Attorney, Agent, or Firm* — US Naval Research Laboratory; Suresh Koshy

(57) ABSTRACT

An apparatus in a surrounding liquid and methods of using same. The apparatus includes an acoustic Fresnel zone plate comprising a compliant frame, a substrate connected to the frame, and an acoustic diffraction grating connected to the substrate. The acoustic diffraction grating includes a plurality of concentric rings or a plurality of concentric islands. The substrate is acoustic-impedance-mismatched with the acoustic diffraction grating. The acoustic Fresnel zone plate includes at least one acoustic focal spot. The substrate is acoustic-impedance-mismatched with the surrounding liquid and the acoustic diffraction grating is acoustic-impedance-matched with the surrounding liquid, or the substrate is acoustic-impedance-matched with the surrounding liquid and the acoustic diffraction grating is acoustic-impedance-mismatched with the surrounding liquid.

20 Claims, 12 Drawing Sheets

(56) References Cited

U.S. PATENT DOCUMENTS

| | | | | |
|---|---|---|---|---|
| 3,815,409 | A * | 6/1974 | Macovski | G01N 29/221 367/101 |
| 4,129,799 | A * | 12/1978 | Green | G10K 11/32 310/359 |
| 4,143,554 | A * | 3/1979 | Nagy | A61B 8/4281 73/620 |
| 4,469,976 | A * | 9/1984 | Scott | G10K 11/32 310/334 |
| 7,697,374 | B2 | 4/2010 | Kitchin et al. | |
| 2009/0306510 | A1* | 12/2009 | Hashiba | G01S 15/8925 600/447 |
| 2014/0112107 | A1* | 4/2014 | Guo | B06B 1/00 367/191 |

OTHER PUBLICATIONS

Calvo, David C., et al. "Thin Fresnel zone plate lenses for focusing underwater sound." Applied Physics Letters 107.1 (2015): 014103. APA.*

Martin, Theodore P., et al. "Transparent gradient-index lens for underwater sound based on phase advance." Physical Review Applied 4.3 (2015): 034003.*

Calvo, David C., et al. "Thin Fresnel zone plate lenses for underwater acoustics: Modeling and experiments." OCEANS'15 MTS/IEEE Washington. IEEE, 2015.*

Hristov, Hristo D., Fresnel Zones in Wireless Links, Zone Plate Lenses and Antennas, 2000, pp. 141-146, 291-292, and 299, Artech House, Norwood, MA, USA.

* cited by examiner

ACOUSTIC FRESNEL ZONE PLATE LENS FOR AQUEOUS ENVIRONMENTS AND METHODS OF USING SAME

CROSS-REFERENCE TO RELATED APPLICATIONS

The present application claims priority to U.S. Provisional Patent Application Ser. No. 62/069,895, entitled "UNDERWATER ACOUSTIC FRESNEL ZONE PLATE LENS" and filed 29 Oct. 2014, to Calvo et al.

FIELD OF THE INVENTION

The invention relates generally to an acoustic apparatus and methods of using same, and more particularly to an acoustic Fresnel zone plate apparatus located in a surrounding liquid and methods of using same.

BACKGROUND OF THE INVENTION

Underwater sound is exploited in both passive and active sonars for the detection, localization, and tracking of both quiet and radiating sources. Sound is also useful for obstacle avoidance, creation, of acoustic images of an underwater scene, and undersea communication. In many such instances, it is necessary to increase the response of an acoustic receiving system to sound arriving from a particular direction. Two methods to accomplish this include signal processing techniques (i.e., beamforming) and acoustic lens techniques. In both cases, an array of sound-sensitive elements is generally used in a receiving system. In the lens case, acoustical images of underwater scenes can be produced by focusing sound onto elements of an array, much like the human eye focuses light onto the retina. Acoustic lenses generally reduce the signal processing and hardware demands on a system which is particularly important for compact, real-time systems. Both techniques can also be used to directionally broadcast sound.

It is particularly challenging to generate high-resolution acoustical images of scenes at low frequencies on small, platforms because physical apertures (i.e., array sizes) must be many wavelengths long. Techniques such as towing long arrays or using platform translation (i.e., synthetic aperture) are commonly used in this regard.

In acoustic communication, similar compactness constraints on the receive end of a system make it difficult to reject multipath interference and ambient noise in favor of direct path symbols. Multipath interference, for example, is a factor that limits bit rate.

BRIEF SUMMARY OF THE INVENTION

An embodiment of the invention includes a method or apparatus for generating high-resolution acoustical images of scenes at low frequencies (e.g., less than 100 kHz), which, are challenging to obtain on small platforms because physical apertures (i.e., array sizes) must be many wavelengths long.

An embodiment of the invention includes an apparatus operably located in a surrounding liquid. The apparatus includes an acoustic Fresnel zone plate comprising a compliant frame, a substrate connected to the frame, and an acoustic diffraction grating connected to the substrate. The acoustic diffraction grating includes a plurality of concentric rings or a plurality of concentric islands. The substrate is acoustic-impedance-mismatched with the acoustic diffraction grating. The acoustic Fresnel zone plate comprising at least one acoustic focal spot. The substrate is acoustic-impedance-mismatched with the surrounding liquid and the acoustic diffraction grating is acoustic-impedance-matched with the surrounding liquid, or the substrate is acoustic-impedance-matched with the surrounding liquid and the acoustic diffraction grating is acoustic-impedance-mismatched with the surrounding liquid.

Another embodiment of the invention includes a method of receiving an acoustic wave. An acoustic wave is received at an acoustic Fresnel zone plate located in a surrounding liquid and including a compliant frame, a substrate connected to the frame, and an acoustic diffraction grating connected to the substrate, the acoustic diffraction grating including a plurality of concentric rings or a plurality of concentric islands, the substrate being acoustic-impedance-mismatched with the acoustic diffraction grating, the acoustic Fresnel zone plate comprising at least one focal spot, wherein the substrate is acoustic-impedance-mismatched with the surrounding liquid and the acoustic diffraction grating is acoustic-impedance-matched with the surrounding liquid, or the substrate is acoustic-impedance-matched with the surrounding liquid and the acoustic diffraction grating is acoustic-impedance-mismatched with the surrounding liquid. The acoustic wave is focused on at least one acoustic sensor connected to the acoustic Fresnel zone plate and located in an area around at least one acoustic focal spot, using the acoustic Fresnel zone plate.

Another embodiment of the invention includes a method of transmitting an acoustic wave. An acoustic Fresnel zone plate is provided. The acoustic Fresnel zone plate is located in a surrounding liquid and comprising a compliant frame, a substrate connected to the frame, and an acoustic diffraction grating connected to the substrate. The acoustic diffraction, grating includes a plurality of concentric tings or a plurality of concentric islands. The substrate is acoustic-impedance-mismatched with the acoustic diffraction grating. The acoustic Fresnel zone plate includes at least one focal spot. The substrate is acoustic-impedance-mismatched with the surrounding liquid and the acoustic diffraction grating is acoustic-impedance-matched with the surrounding liquid, or the substrate is acoustic-impedance-matched with the surrounding liquid and the acoustic diffraction grating is acoustic-impedance-mismatched with the surrounding liquid. An omnidirectional acoustic wave is impinged on the acoustic Fresnel zone plate using a spherical wave acoustic source, thereby generating a planar acoustic wave.

DETAILED DESCRIPTION OF THE INVENTION

Inventors recognized a need for acoustical technology for generating high-resolution scenes for in-liquid platforms of limited size and translation capability. Inventors further recognized a need, for real-time high-gain directional receivers that can be compactly deployed. Traditionally, in acoustics, lenses analogous to those used in optics have been used for real-time imaging in the ocean, inventors appreciated that they become large and bulky, however, when applied to longer wavelength sound.

Historically, Fresnel zone plate lenses have not been used in acoustics. Instead, they have been used in optics, RF, and soft x-ray systems, when thin planar lenses are advantageous from a manufacturing standpoint or when desired refractions of waves are practically difficult to achieve with common materials and conventional lens shapes. Fresnel zone plates differ from standard optical lenses in that they typically have planar faces and can be made very thin. They also differ from thin-lens designs, termed Fresnel lenses, that resemble standard optical lenses with redundant thickness regions removed. The Soret-type Fresnel zone plate, for example, obstructs optical transmission through alternating Fresnel zones to create a real focus by constructive interference of diffracted waves. In spite of the non-use of Fresnel zone plates in acoustics, Inventors appreciated that Fresnel zone plate Senses could meet the needs of large aperture and compact deployment.

Figure 1:
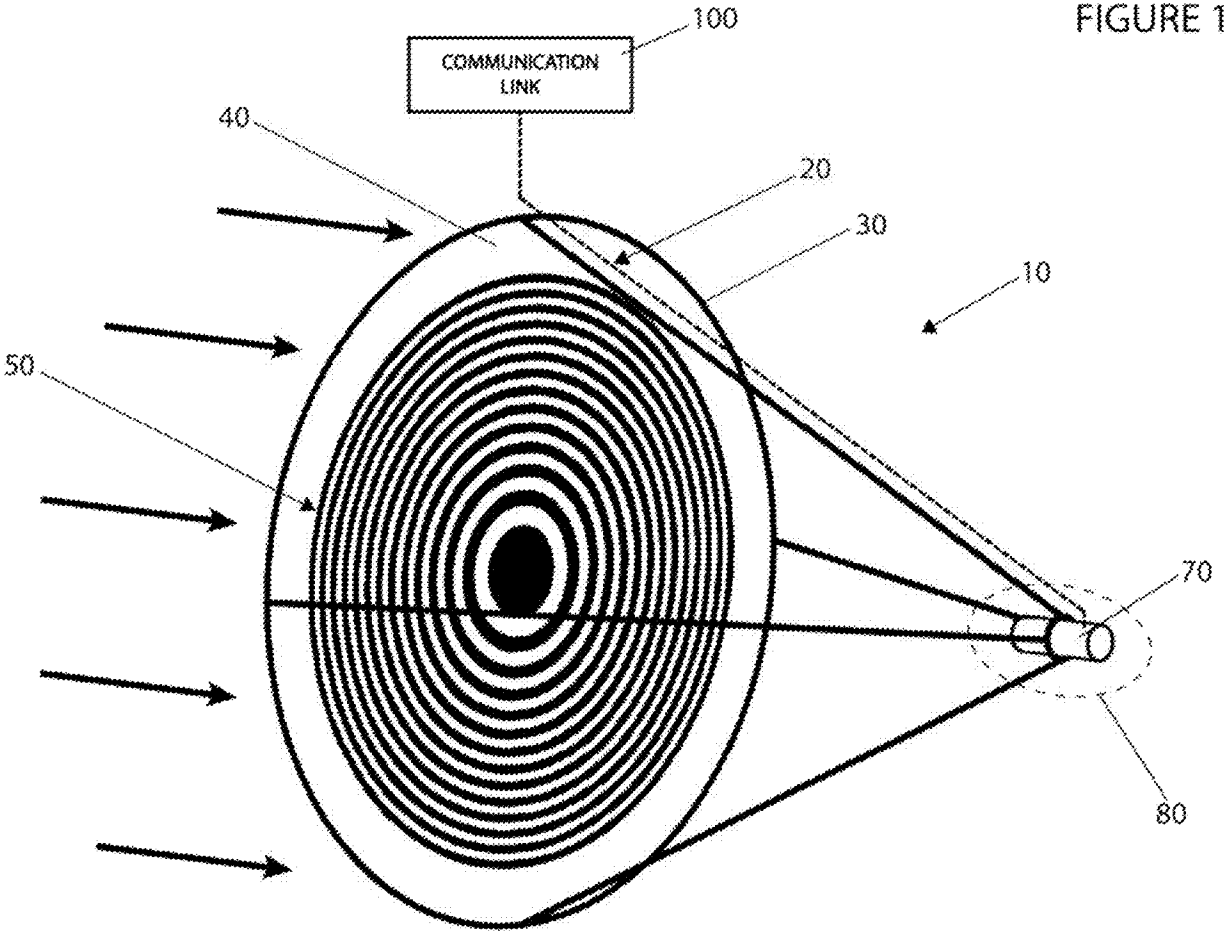
FIG. 1 is a perspective view of an illustrative one-sided receiving system for a normal incidence plane wave, according to an embodiment of the invention.
Figure 2A:
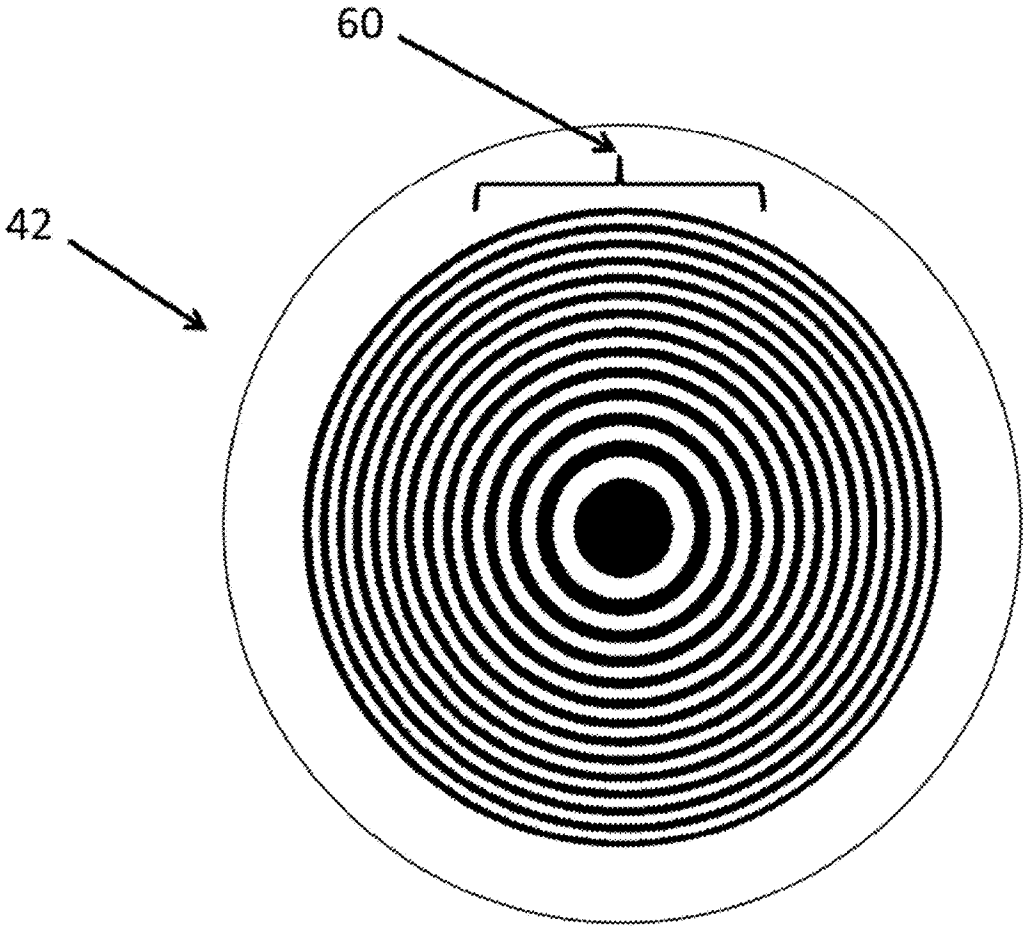
FIG. 2A shows an illustrative sheet-like Fresnel zone plate, according to an embodiment of the invention.

An embodiment of the invention includes an apparatus 10 operably located in a surrounding liquid and is described as follows with illustrative reference to FIGS. 1, 2A-2C, and 3. The apparatus 10 includes an acoustic Fresnel zone plate 20. The acoustic Fresnel zone plate 20 comprising a compliant frame 30, a substrate 40 connected, to the frame, and an acoustic diffraction grating 50 connected to the substrate, The acoustic diffraction grating 50, for example, includes a plurality of concentric rings 60, such as shown in FIG. 2A or a plurality of concentric islands, such as described and/or shown in Hristov, Hristo D., Fresnel Zones in Wireless Links, Zone Plate Lenses and Antennas, 2000, pp. 141-146, 291-292, and 299, Artech House, Norwood, Mass., USA, ("Hristov") incorporated herein by reference. The substrate 40 is acoustic-impedance-mismatched with the acoustic diffraction grating 50. The acoustic Fresnel zone plate 20 includes at least one acoustic focal spot 80. Either the substrate 40 is acoustic-impedance-mismatched with the surrounding liquid and the acoustic diffraction, grating 50 is acoustic-impedance-matched with the surrounding liquid, or the substrate 40 is acoustic-impedance-matched with the surrounding liquid and the acoustic diffraction grating 50 is acoustic-impedance-mismatched with the surrounding liquid.

The Fresnel zone plate 20 increases a response of a receiving system to an acoustic wave from a particular direction. The acoustic wave, for example, is represented in FIG. 1 by the bold, rays directed normally toward the Fresnel zone plate 20. For example, the acoustic wave is a planar sound wave of wavelength λ normally incident on the Fresnel zone plate 20. Sound is diffracted through the acoustically transparent regions of the Fresnel zone plate (i.e., those closely impedance matched with the liquid). The diffracted waves interfere on-axis to produce the acoustic focal spot 80. For a desired focal length F and wavelength λ, the radii of the disk and ring boundaries illustratively shown in FIG. 1 are given by $$r_n = \sqrt{n\lambda F + \frac{n^2\lambda^2}{4}}\ , n = 1, 2, \ldots N,$$

where the number of zones N is equal to the number of rings by $N=2N_{rings}+1$. Per this expression, $r_n$ are the radii of the transitions between acoustically opaque regions and acoustically transparent regions of the Fresnel zone plate. This expression is based on the requirement of suppressing zones that would emit waves that destructively interfere with those emitted from the transparent zones. It should be understood by one of ordinary skill in the art that acoustic diffraction gratings are available in a number of standard alternative patterns, depending on the application. Examples of such alternative acoustic diffraction grating patterns are found in Hristov, incorporated herein by reference.

Optionally, the frame 30 includes a standard pre-stressed (or spring-loaded) frame or a standard liquid-inflatable frame. Both types of frames, for example, allow structures to be folded into a volume with characteristic side dimensions smaller than a characteristic overall dimension of the unfolded geometry. The spring-loaded frame is, for example, of a type similar to that used in standard pop-up tents or in standard light-diffusing enclosures for photography. The water-inflatable frame is, for example, filled by a standard small water pump. An illustrative, spring-loaded frame suspends a flexible substrate and an acoustic sensor, such as discussed below. The spring-loaded frame and flexible substrate enable deployment from a small volume. Once expanded, the apparatus 10 can be supported in several ways including attachment to a surface float or moored to the bottom of the body of water (e.g., the ocean). The apparatus is, for example, completely surrounded by a liquid. The liquid, for example, is nominally water, but could, alternatively be fluids of comparable density such as suspensions, emulsions, unconsolidated marine sediments, gel, or oil.

Figure 2B:
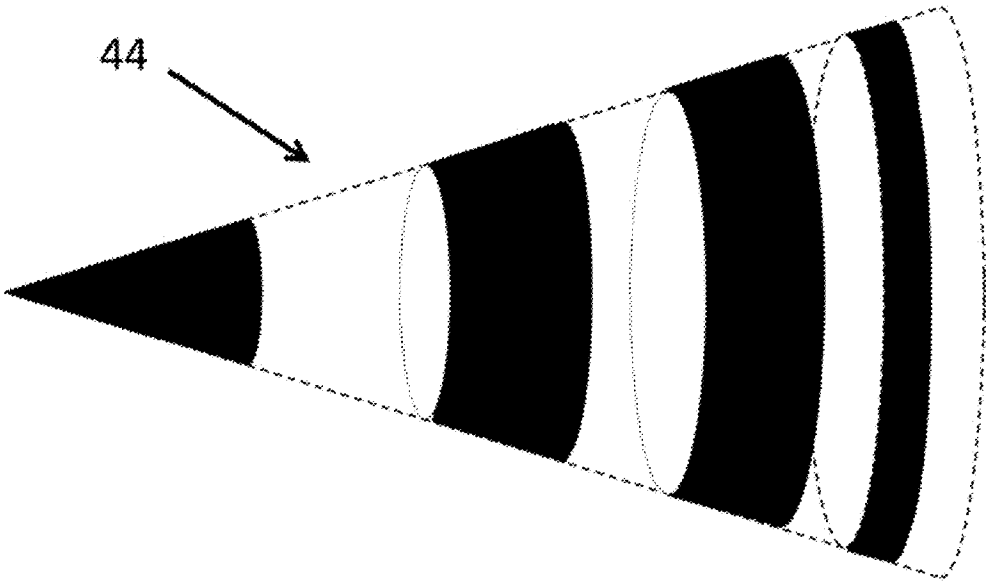
FIG. 2B shows another illustrative conical Fresnel zone plate, according to an embodiment of the invention.
Figure 2C:
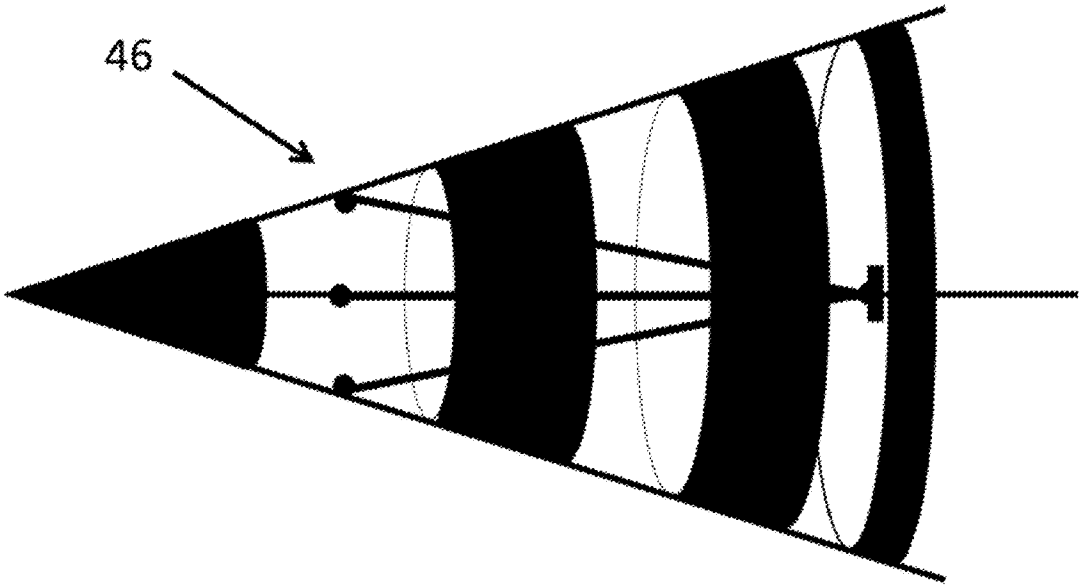
FIG. 2C shows yet another illustrative Fresnel zone plate with a structural linkage, according to an embodiment of the invention.

Optionally, the substrate 40 includes a standard sheet 42 (or film) as shown by way of illustration in FIG. 2A, a standard cone 44 (represented by the dashed lines connecting the plurality of concentric rings 60 or the plurality of concentric islands) as shown by way of illustration in FIG. 2B, and/or a standard linkage 46 including a plurality of structural links (represented by the solid lines connecting the plurality of concentric rings 60 or the plurality of concentric islands) as shown by way of illustration in FIG. 2C. The sheet is rigidly planar or compliant. The standard linkage 46. for example, includes an umbrella-like linkage or a spider-web-like linkage.

Acoustic diffraction, of the type consistent with an embodiment of the invention, requires an acoustic impedance mismatch between materials in order to reduce transmission through an interface and generally to increase reflection. Materials possess a characteristic acoustic impedance $Z=\rho c$ where $\rho$ is the material density and c is the speed of sound in the material. Materials also possess an acoustic attenuation, which reduces transmission in a physically distinct way from reflection. Nevertheless, if sound speed is allowed to be complex-valued, attenuation can be incorporated in the impedance leading to a generally complex impedance. Optionally, the substrate 40 includes standard flexible rubber, standard flexible foil, or standard rubber foam. In the modeling of sound transmission through a layer, the thickness of the layer generally factors into the total acoustic impedance, which is distinct from the characteristic acoustic impedance, which is a bulk property. In the case of foil, for example, an extremely thin metal foil may present little acoustic impedance, but a relatively thick foil (i.e., a foil having a significant traction of a sound wavelength or greater) may present relatively high acoustic impedance. In the acoustic impedance examples that follow, acceptable materials for use in embodiment of the invention are assumed to be not excessively thin to the point of presenting no acoustic impedance. The acoustic diffraction grating 50 includes standard flexible rubber, standard flexible foil, or standard rubber foam. For example, the flexible foil is a plastic foil or a metal foil. For example, the substrate 40 includes a thin rubber sheet or foil of impedance $Z_s$ that is close to (or, is effectively matched) to the impedance of the liquid $Z_{liq}$. For example, the diffraction grating 50 includes a disk and rings of material with impedance $Z_{dg}$ that is mismatched with water. To convey the degree of sufficient matching and mismatching required of the real-valued impedance for consistency with an embodiment of the instant invention. Table 1 presents illustrative materials for making a Fresnel zone plate consistent with art embodiment of the invention. For example, the substrate 40 is made of standard silicone rubber, and the diffraction grating 50 is made of standard rubber foam. Silicone rubber gives a sufficient impedance match to water, while providing favorable flexibility. Rubber foam provides a sufficient impedance mismatch to water without, being excessively buoyant. A standard closed-cell foam containing 32% gas greatly decreased acoustic impedance.

TABLE 1

| Material | Density (kg/m$^3$) | Sound speed (m/s) | Attenuation (dB/λ) | Acoustic Impedance (rayls) | Relative Impedance |
|---|---|---|---|---|---|
| Rubber foam | 680 | 272 | 11.2 | 184,960 | 0.125 |
| Silicone rubber | 1020 | 1042 | 0.03 | 1,062,840 | 0.717 |
| Water | 1000 | 1482 | — | 1,482,000 | 1.0 |
| Air | 1.2 | 343 | — | 411 | 0.0003 |

Optionally, the plurality of concentric rings 60 or the plurality of concentric islands lie one of in a plane or in a plurality of respective planes. As to the latter construct, for example, the plurality of concentric rings 60 or the plurality of concentric islands lies against a curved surface, such as a side of a marine vessel.

Figure 3:
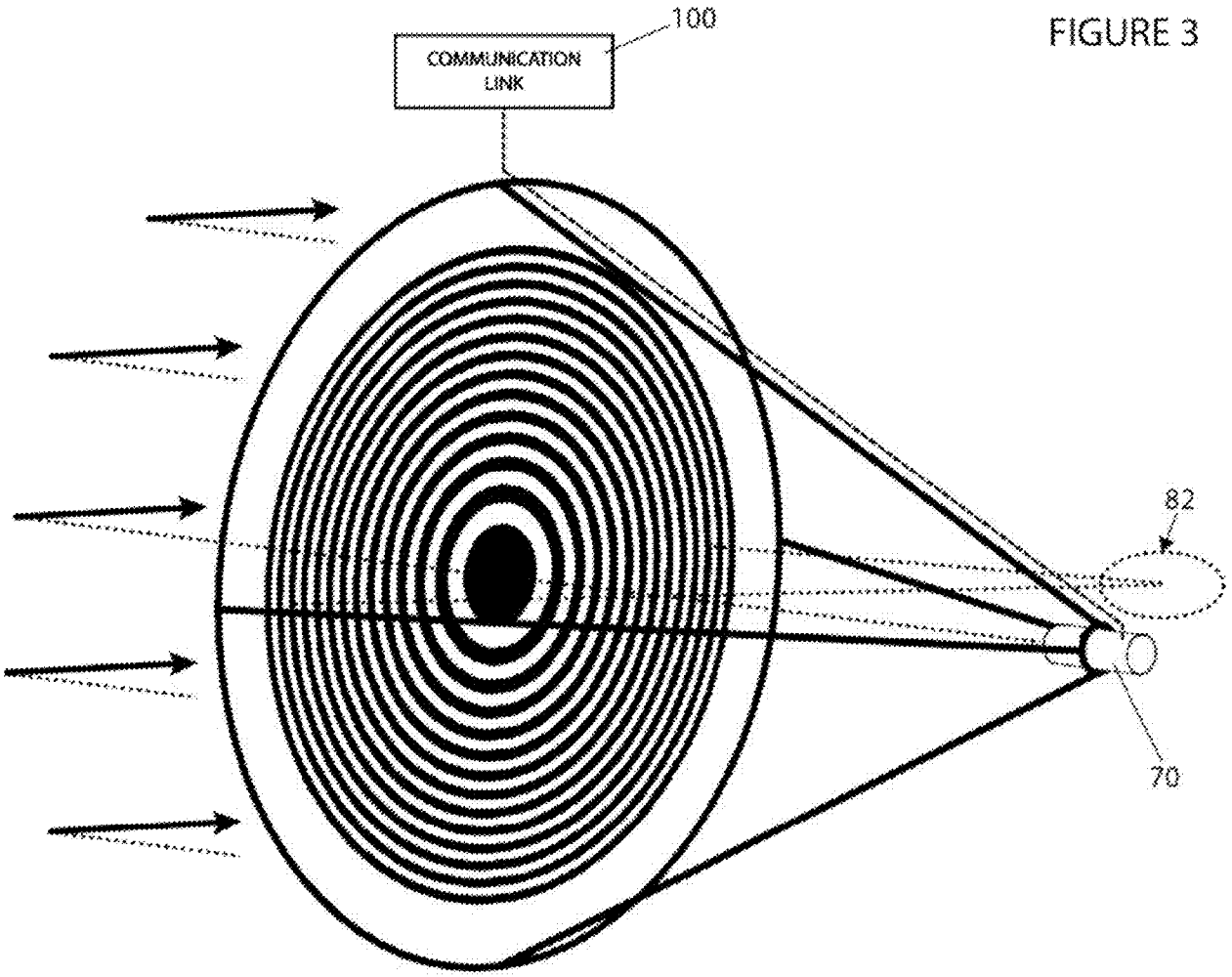
FIG. 3 is a perspective view of a one-sided receiving system, showing a shift of focus for a plane wave with an off-axis plane wave incidence angle, according to an embodiment of the invention.

Optionally, the apparatus 10 according further includes at least one standard acoustic sensor 70 connected to the acoustic Fresnel zone plate 20 by the frame 30 and located in an area around the at least one acoustic focal spot 80. Whereas FIG. 1 shows an illustrative on-axis acoustic plane wave incident on the Fresnel zone plate 20, FIG. 3 shows an illustrative off-axis plane wave incident on the Fresnel zone plate 20. In FIG. 3, the off-axis plane wave is represented by the bolded rays that are offset from the normal dashed line segments, which represent an on-axis plane wave. In FIG. 3, showing the off-axis case, the focal spot 82 no longer overlaps the at least, one acoustic sensor 70, and so the apparatus 10 is relatively insensitive to waves from off-axis directions. The apparatus 10 therefore acts much like a parabolic dish in radio wave applications.

Figure 4:
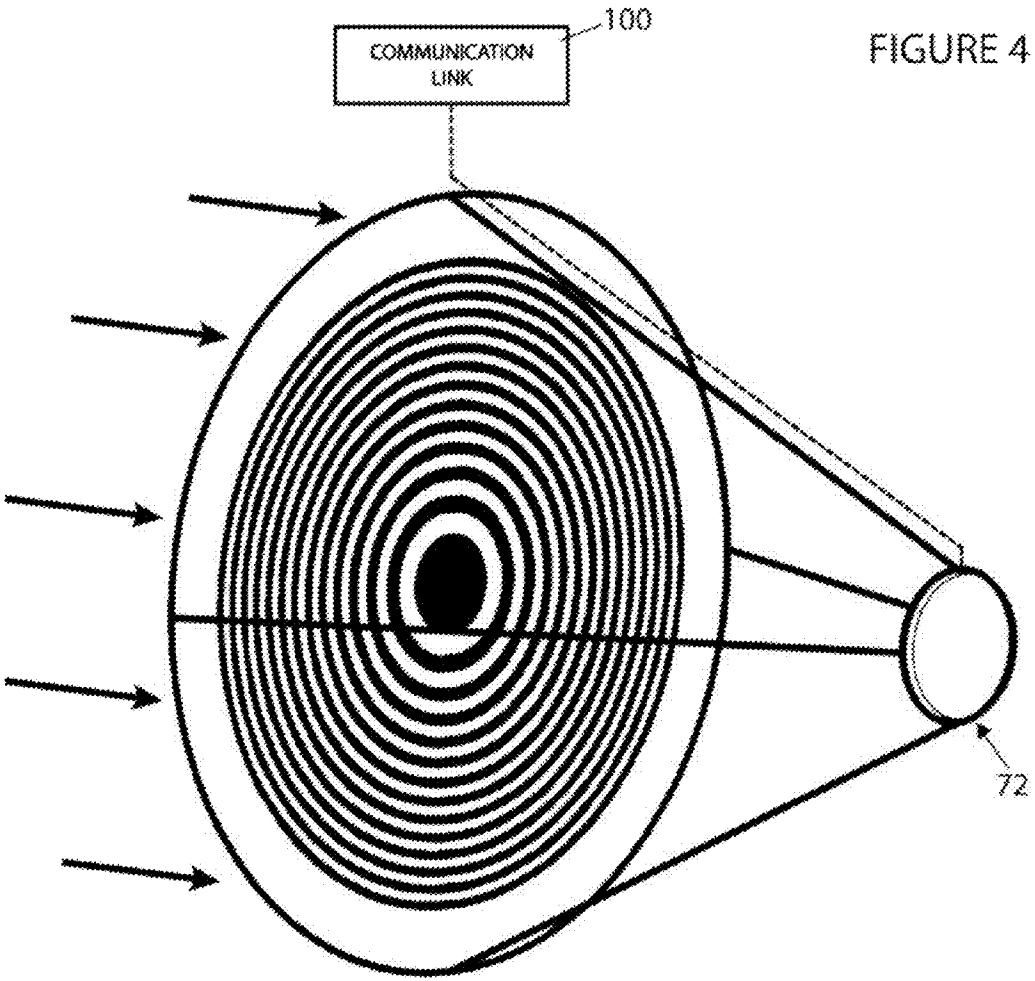
FIG. 4 is a perspective view of an illustrative one-sided receiving system with an array of sensors in the local plane, according to an embodiment of the invention.
Figure 5A:
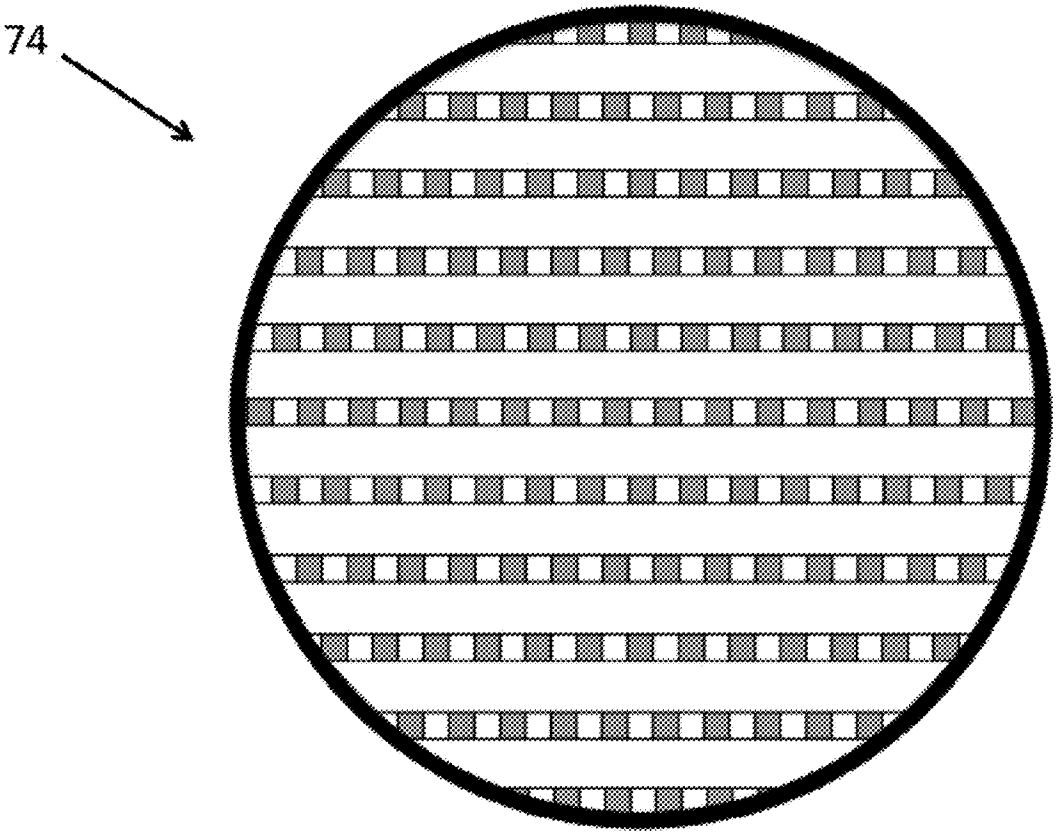
FIG. 5A shows an illustrative two-dimensional sparse array of acoustic sensors, according to an embodiment of the invention.
Figure 5B:
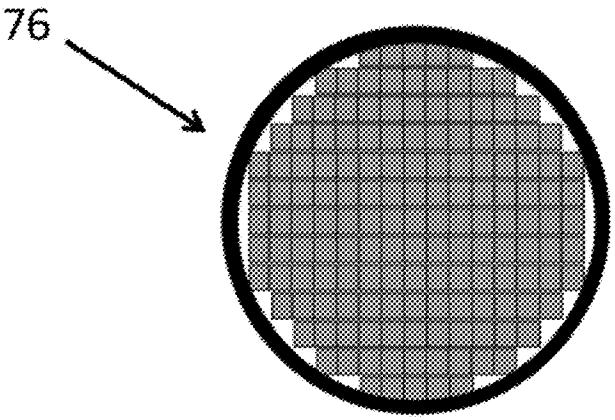
FIG. 5B shows an illustrative two-dimensional dense array of acoustic sensors, according to an embodiment of the invention.
Figure 5C:
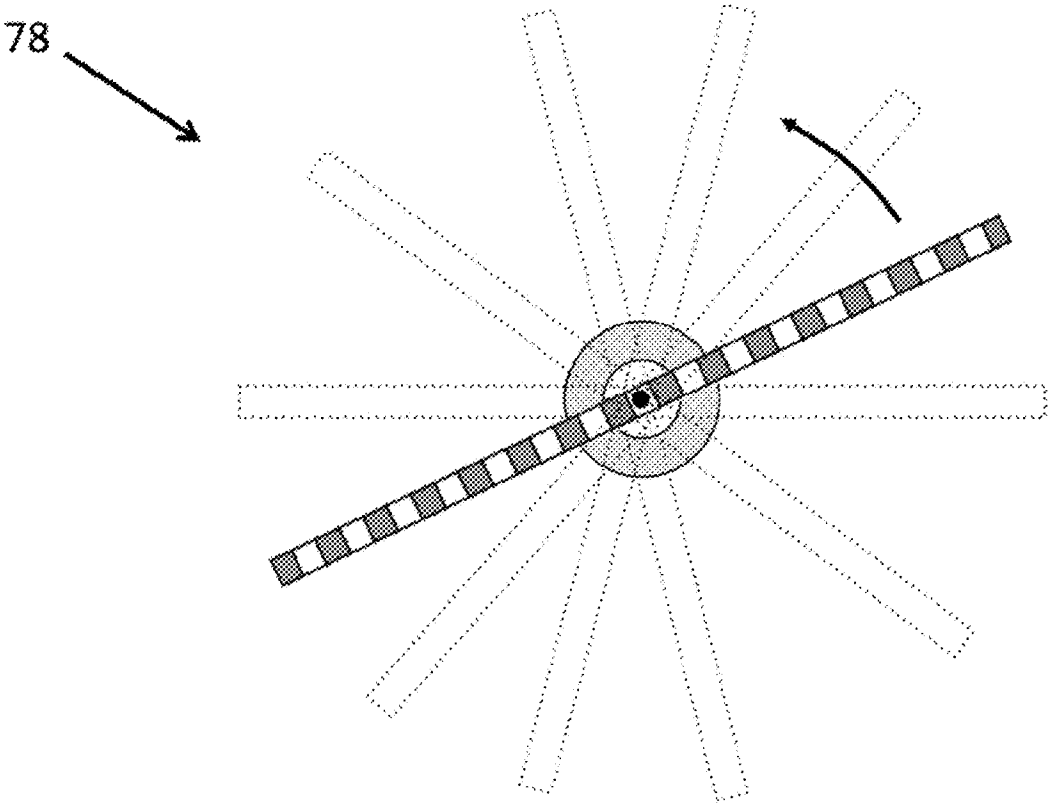
FIG. 5C shows an illustrative rotatable one-dimensional array or line of acoustic sensors, according to an embodiment of the invention.

Optionally, the at least one acoustic sensor 70 includes a standard array of acoustic sensors 72, as shown by way of illustration in FIG. 4. For example, the standard array of acoustic sensors includes a standard two-dimensional sparse array of standard vector sensors 74, such as shown by way of illustration in FIG. 5A, a standard two-dimensional dense array of standard vector sensors 76, such as shown by way of illustration in FIG. 5B, or a standard rotatable line or array of standard vector sensors 78, such as shown by way of illustration in FIG. 5C. An illustrative vector sensor, for example, includes a combined standard acoustic pressure sensor and standard acoustic velocity sensor. Sparse arrays are useful, in high signal-to-noise ratio Imaging situations where fine sampling may not be required. Optionally, the rotatable line or array of standard vector sensors 78 includes standard mechanical steering to create an acoustical image. One of ordinary skill in the art will appreciate that a fixed array of acoustic sensors (e.g., a two-dimensional dense array of sensors or a two-dimensional sparse array of sensors) requires more sensors on the focal plane in order to generate an acoustic image than would be required if the rotatable line or array of standard vector sensors 78 were used. In such an embodiment of the invention, the communication link 100, for example, includes a standard multi-channel communication link to exfiltrate the signals from each sensor element. One of ordinary skill in the art will appreciate that the required radial extent of the sensor array depends on the field of view required by the application. The lateral displacement 8 of the focal spot as a function of incidence angle $\theta_i$ is well approximated by $\delta=F \tan \theta_i$. Optionally, because lightweight flexible construction is useful, piezoelectric polymers, such as, polyvinylidene fluoride ("PVDF"), are useful to create sensor elements.

A focal spot is obtained on the transmission side of the Fresnel zone plate 20 (which is referred to as the back side) and another focal spot on the reflection side (referred to as the front side). An embodiment of the invention with the at least one acoustic sensor on only side of the Fresnel zone plate therefore exhibits a certain directional ambiguity: if only a single sensor on the back side is used, the apparatus cannot discern if the focusing energy is coming from a transmission through the zones or a reflection from the opaque zones.

Figure 6:
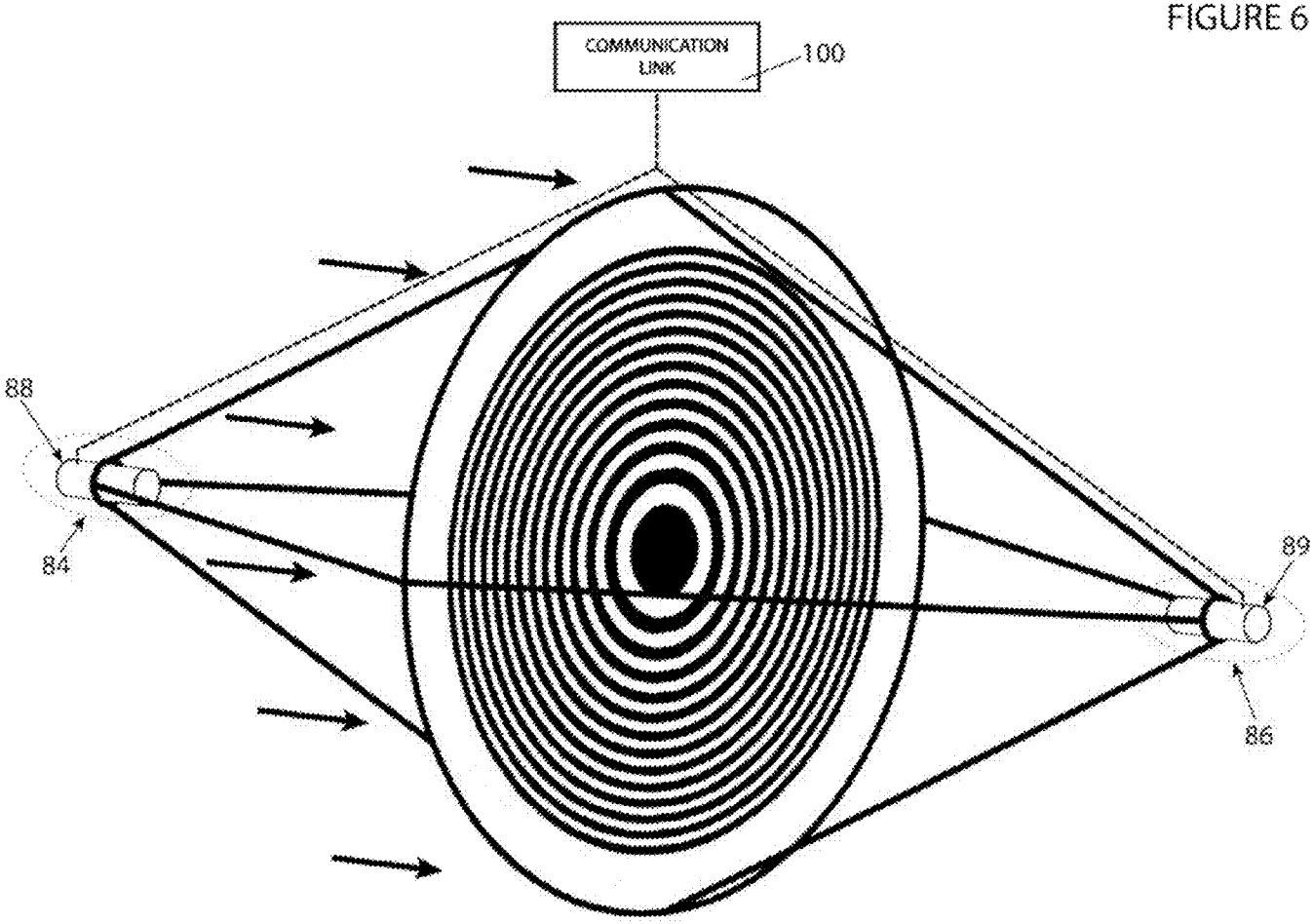
FIG. 6 is a perspective view of an illustrative two-sided receiving system for a normal incidence plane wave, according to an embodiment of the invention.

To disambiguate the direction of a received acoustic wave, optionally, in another embodiment of the invention, such as shown by way of illustration in FIG. 6, the at least one acoustic focal spot 80 includes at least one front focal spot 84 and at least one back, focal spot 86. The at least one front focal spot 84 and the at least one back focal spot 86 are positioned symmetrically relative to (e.g., about the plane of) the acoustic Fresnel zone plate 20. The acoustic Fresnel zone plate 20 comprising a front side and a back side. The at least one acoustic sensor 80 includes at least one front sensor 88 located on the front side in an area around said at least one front focal spot 84 and at least one back sensor 89 located on the back side in an area around said at least one back local spot 86. Optionally, the apparatus 10 further includes a standard communication link 100, such as a standard 2-channel communication link, operably communicating with at the least one acoustic sensor 80. For example, the communication link 100 conveys the signal generated at the at least one acoustic sensor 80 to a final destination where monitoring of the underwater environment is being made. Directional disambiguation results from acoustic intensity asymmetry between the front side and the back side sensors. In an illustrative embodiment of the invention, a 4 dB asymmetry in the focal levels is apparent with the focus on the front side being stronger than on the back side. This acoustic intensity asymmetry is caused by partial transmission through the opaque zones which are not perfectly obstructing. In contrast, the front side focus is strong because reflections are only significant from, the alternating zones. Attenuation of the opaque zones also contributes to focal asymmetry. Two signals are now conveyed by the 2-channel communication link. This embodiment of the invention cars determine the direction of arrival of the acoustic plane wave.

Optionally, the surrounding liquid includes water, water suspensions, unconsolidated marine sediments, gel, or oil. For example, components of and materials for an embodiment of the invention are selected so that the embodiment can be immersed in water and have near neutral buoyancy.

Figure 7:
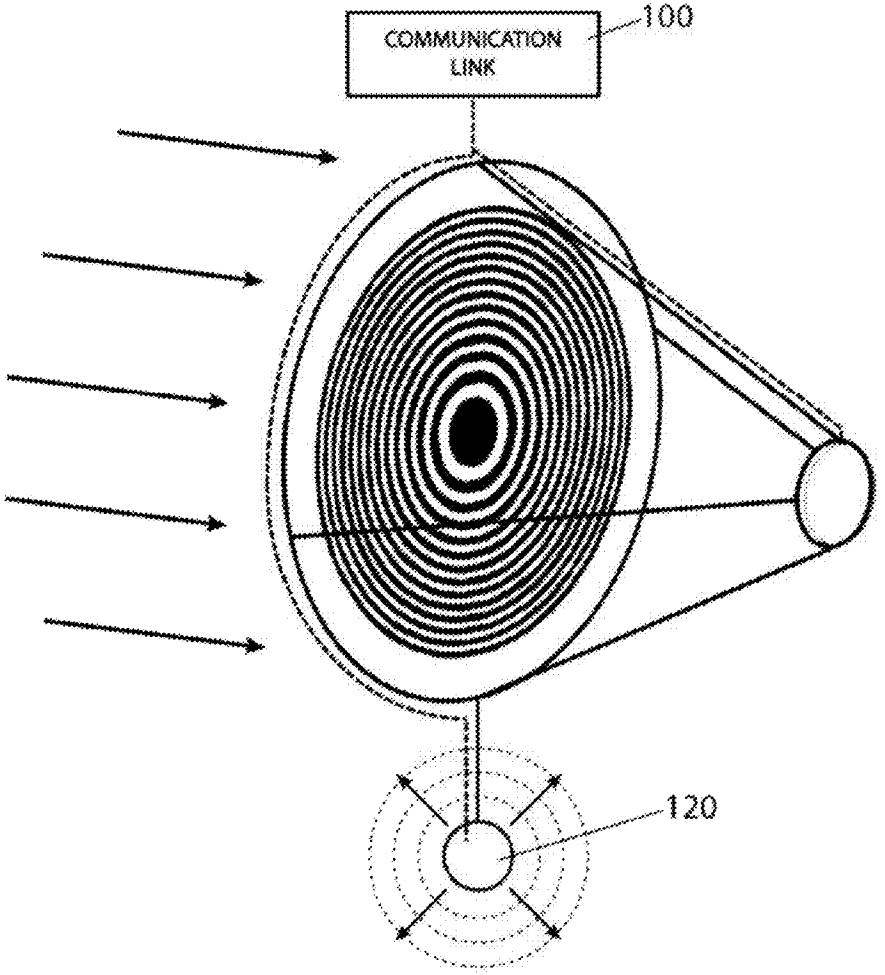
FIG. 7 shows an illustrative perspective view of a receiving system combined with an omnidirectional transmitter, according to an active sonar embodiment of the invention.

Optionally, an embodiment of the invention includes the apparatus 10 as part of an active sonar system, such as shown by way of illustration in FIG. 7 Optionally, the apparatus further includes an acoustic wave source 120 operatively oriented away from the acoustic Fresnel zone plate 20, such as shown by way of illustration in FIG. 7. The acoustic wave source 120, for example, includes a standard communication link and/or a standard power link. For example, the acoustic wave source 120 generates an omnidirectional acoustic wave, which bounces off a target and onto the acoustic Fresnel zone plate 20 so that the at least one acoustic sensor 80 detects the target.

Figure 8:
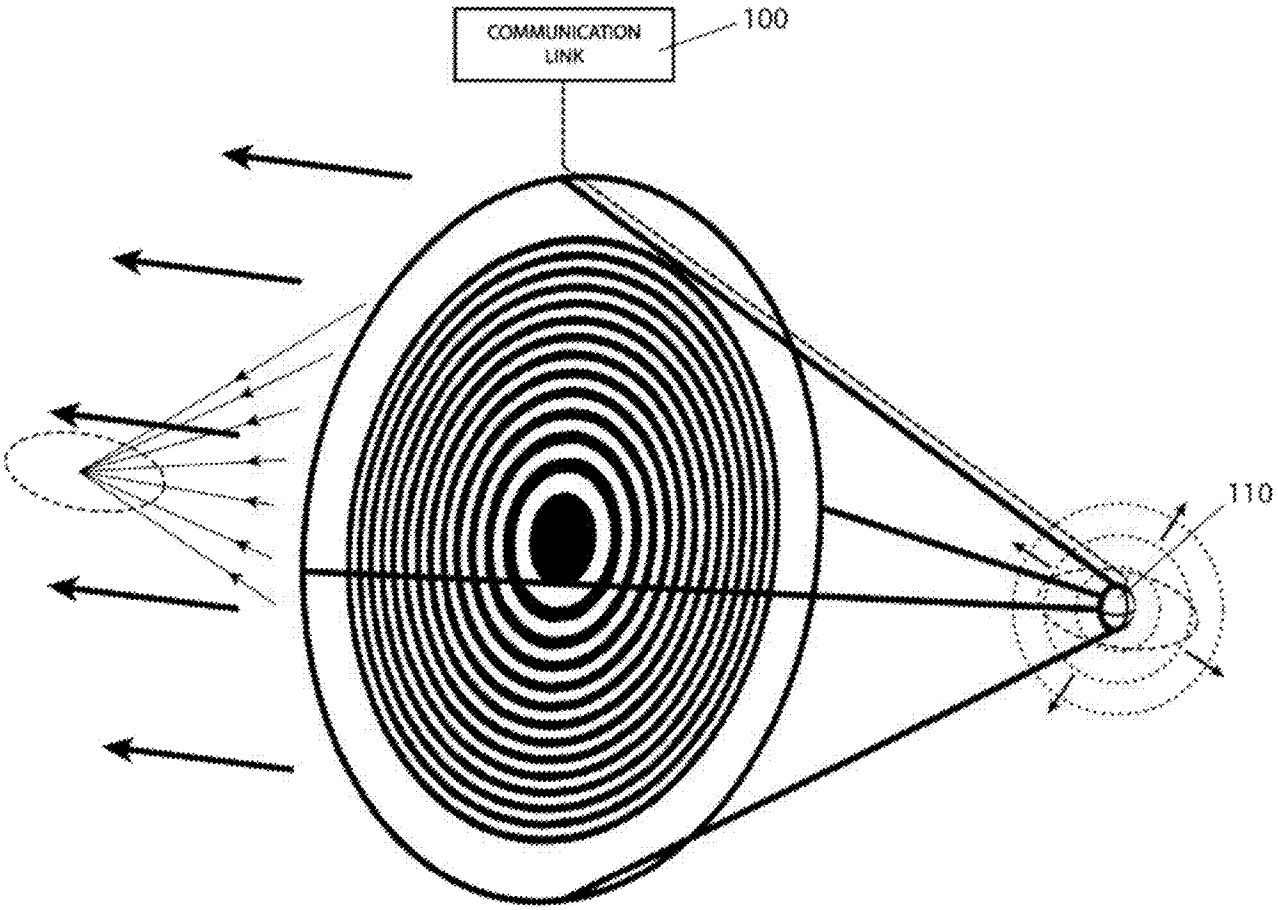
FIG. 8 shows an illustrative perspective view of a directional projector system using a Fresnel zone plate lens, according to an embodiment of the invention.

Optionally, another embodiment of the invention includes the apparatus 10 as part, of a sound projection system, such as shown by way of illustration in FIG. 8. The active sonar system, for example, includes a standard communication link 100. For example, the communication link includes a standard bi-directional communication link and, for example, a standard power link. Optionally, the apparatus 10 further includes a standard spherical wave (or omnidirectional) acoustic source 110 operably communicating with the acoustic Fresnel zone plate 20. Optionally, the apparatus 10 further includes a standard communication link 100 operably communicating with the spherical wave acoustic source 110. For example, the communication link 100 conveys the signal to be generated by the spherical wave acoustic source 110 from a remote site, where monitoring of the underwater environment is being made. The acoustic wave source 110 then transmits an omnidirectional acoustic signal corresponding to the conveyed signal toward the acoustic Fresnel zone plate 20, which in turn transforms the spherical acoustic signal into a planar acoustic wave with, a direction as aimed by the acoustic Fresnel zone plate. In this embodiment of the invention, the Fresnel zone plate is used to create a sound beam by insonifying it with an omnidirectional, sound source placed at the locus. When the omnidirectional wavefront interacts with the Fresnel zone plate, part of the energy forms a spherical converging wavefront and a collimated beam wavefront. Optionally, embodiment further includes, for example, a communication link that exfiltrates the received sensor signal and/or a power link that supplies power to the source. This embodiment of the invention, for example, uses the same source transducer to transmit and receive sound.

Another embodiment of the invention includes a method of receiving an acoustic wave. An acoustic wave is received at an acoustic Fresnel zone plate. The acoustic Fresnel zone plate is located in a surrounding liquid and including a compliant frame, a substrate connected to the frame, and an acoustic diffraction grating connected to the substrate. The acoustic diffraction grating includes a plurality of concentric rings or a plurality of concentric islands. The substrate is acoustic-impedance-mismatched with the acoustic diffraction grating. The acoustic Fresnel zone plate includes at least one focal spot. The substrate is acoustic-impedance-mismatched with the surrounding liquid and the acoustic diffraction grating is acoustic-impedance-matched with the surrounding liquid, or the substrate is acoustic-impedance-matched with the surrounding liquid and the acoustic diffraction grating is acoustic-impedance-mismatched with the surrounding liquid. The acoustic wave is focused on at least one acoustic sensor connected to the acoustic Fresnel zone plate and located in an area around at least one acoustic focal spot, using the acoustic Fresnel zone plate.

Optionally, at least one acoustic sensor includes a sparse array of vector sensors, a dense array of vector sensors, or a rotatable array of vector sensors.

Optionally, the at least one acoustic sensor is connected, to the acoustic Fresnel zone plate and located in an area around at least one acoustic focal spot. Further, the at least one acoustic focal spot includes at least one front focal spot and at least one back focal spot, the acoustic Fresnel zone plate including a front side and a back side, the at least one acoustic sensor including at least one front sensor located on the front side in an area around the at least one front focal spot and at least one back sensor located on the back side in an area around the at least one back focal spot. The acoustic wave is directionally located, using the at least one front sensor and the at least one back sensor.

Optionally, the acoustic wave is transmitted from an active acoustic wave source operatively oriented away from the acoustic Fresnel zone plate.

Optionally, the focused acoustic wave is transmitted, using a communication link operably communicating with the at least one acoustic sensor.

Another embodiment of the invention includes a method of transmitting an acoustic wave. An acoustic Fresnel zone plate is provided. The acoustic Fresnel zone plate is located in a surrounding liquid and comprising a compliant frame, a substrate connected to the frame, and an acoustic diffraction grating connected to the substrate. The acoustic diffraction grating includes a plurality of concentric rings or a plurality of concentric islands. The substrate is acoustic-impedance-mismatched with the acoustic diffraction grating. The acoustic Fresnel zone plate includes at least one focal spot. The substrate is acoustic-impedance-mismatched with the surrounding liquid and the acoustic diffraction grating is acoustic-impedance-matched with the surrounding liquid, or the substrate is acoustic-impedance-matched with the surrounding liquid and the acoustic diffraction grating is acoustic-impedance-mismatched with the surrounding liquid. A spherical acoustic wave is impinged on the acoustic Fresnel zone plate using a spherical wave acoustic source, thereby generating a planar acoustic wave.

Optionally, the acoustic wave source is operated from a remote site using a communication link.

For completeness, an illustrative method of manufacturing a soft Fresnel zone plate according to an embodiment of the invention, is described as follows. A rubber foam is created by mixing a standard two-part silicone rubber compound with, standard microballoons, which expand during the heating/curing process. Standard unexpanded microballoons are added at 5% weight fraction to the standard silicone rubber (e.g., RTV-615) mixed in. the standard 10:1 monomer-to-hardener ratio. The mixture is then heated at 105° C. for 1 hour, which expands the microballoons and cures the silicone rubber. For material characterization purposes, a 12.7 cm diameter, 3 mm thick disk is created with a measured density of $\rho_f$=680 kg/m$^3$ (32% gas) which is lower than the water density $\rho$=1000 kg/m$^3$ but not excessively buoyant. A transmitted pulse through a sample 3 mm thick plate of this rubber foam material yields a compression wave speed of $c_f$=272 m/s at 200 kHz and an attenuation of 11.2 dB/$\lambda$. Given the water sound speed of c=1482 m/s, the rubber foam has an acoustic impedance ($\rho c$) 0.125 that of water.

The Fresnel zone plate is further fabricated by standard computer numerical control milling rectangular annular grooves of 3 mm deep into an acrylic mold given radii as discussed above. The mold is filled with the unexpanded RTV-615/microballoon mixture, heated, and cured. The excess expanded foam is shaved flush with the mold. A 1 mm thin RTV-615 substrate layer is then poured adheres to the rings after caring and enables removal from the mold.

The lens geometry constructed according to the manufacturing process described above, for example, has an outermost Fresnel zone radius R=16.6 cm and focal length F=8.75 cm for $N_{rings}$=13 ($N=2N_{rings}+1$ is the total number of zones). This desired focal length is obtained for a f=200 kHz plane wave of wavelength $\lambda$=7.4 mm. The blocking zones consist of 3 mm thick, rectangular cross section, foam rings bonded to a 1 mm thin RTV-615 substrate film of density $\rho_p$=1020 kg/m$^3$ and sound speed $c_p$=1042 m/s.

This written description sets forth the best mode of the invention and provides examples to describe the invention and to enable a person of ordinary skill in the art to make and use the invention. This written description does not limit the invention to the precise terms set forth. Thus, while the invention has been, described in detail with reference to the examples set forth above, those of ordinary skill in the art may effect alterations, modifications and variations to the examples without departing from the scope of the invention.

These and other implementations are within the scope of the following claims.

What is claimed as new and desired to be protected by Letters Patent of the United States is:

1. An apparatus operably located in a surrounding liquid, the apparatus comprising:

an acoustic Fresnel zone plate comprising a compliant frame, a substrate connected to said frame, and an acoustic diffraction grating connected to said substrate, said acoustic diffraction grating comprising one of a plurality of concentric rings and a plurality of concentric islands, said substrate being acoustic-impedance-mismatched with said acoustic diffraction grating, said acoustic Fresnel zone plate comprising at least one focal spot, wherein one of said substrate is acoustic-impedance-mismatched with the surrounding liquid and said acoustic diffraction grating is acoustic-impedance-matched with the surrounding liquid, and said substrate is acoustic-impedance-matched with the surrounding liquid and said acoustic diffraction grating is acoustic-impedance-mismatched with the surrounding liquid.

2. The apparatus according to claim 1, wherein said frame comprises one of a spring-loaded frame and a liquid-inflatable frame.

3. The apparatus according to claim 1, wherein said substrate comprises at least one of a sheet, a cone, and a linkage comprising a plurality of structural links connecting one of said plurality of concentric rings and said plurality of concentric islands, said sheet being one of rigidly planar and compliant.

4. The apparatus according to claim 1, wherein said substrate comprises one of flexible rubber, flexible foil, and rubber foam, said acoustic diffraction grating comprising one of said flexible rubber, said flexible foil, and said rubber foam.

5. The apparatus according to claim 1, wherein one of said plurality of concentric rings and said plurality of concentric islands lie one of in a plane and in a plurality of respective planes.

6. The apparatus according to claim 1, further comprising:

at least one acoustic sensor is connected to said acoustic Fresnel zone plate and located in an area around at least one acoustic focal spot.

7. The apparatus according to claim 6, wherein the at least one acoustic sensor comprises one of a sparse array of vector sensors, a dense array of vector sensors, and a rotatable array of vector sensors.

8. The apparatus according to claim 6, wherein said at least one acoustic focal spot comprises at least one front focal spot and at least, one back local spot, said acoustic Fresnel zone plate comprising a front side and a back side, said at least one acoustic sensor comprising at least one front sensor located on the front side in an area around said at least one front focal spot and at least one back sensor located on the back side in an area around said at least one back focal spot.

9. The apparatus according to claim 1, wherein the surrounding liquid comprises one of water, water suspensions, unconsolidated marine sediments, gel, and oil.

10. The apparatus according to claim 6, further comprising:

a communication link operably communicating with said at least one acoustic sensor.

11. The apparatus according to claim 1, further comprising:

a spherical wave acoustic source operably communicating with said acoustic Fresnel zone plate.

12. The apparatus according to claim 11, further comprising:

a communication link operably communicating with said spherical wave acoustic source.

13. The apparatus according to claim 1, further comprising:

an acoustic wave source operatively oriented away from said acoustic Fresnel zone plate.

14. A method comprising:

receiving an acoustic wave at an acoustic Fresnel zone plate located in a surrounding liquid and comprising a compliant frame, a substrate connected, to the frame, and an acoustic diffraction grating connected to the substrate, the acoustic diffraction grating comprising one of a plurality of concentric rings and a plurality of concentric islands, the substrate being acoustic-impedance-mismatched with the acoustic diffraction grating, the acoustic Fresnel zone plate comprising at least one focal spot, wherein one of the substrate is acoustic-impedance-mismatched with the surrounding liquid and the acoustic diffraction grating is acoustic-impedance-matched with the surrounding liquid, and the substrate is acoustic-impedance-matched with the surrounding liquid and the acoustic diffraction grating is acoustic-impedance-mismatched with the surrounding liquid; and focusing the acoustic wave on at least one acoustic sensor connected to the acoustic Fresnel zone plate and located in an area around at least one acoustic focal spot, using the acoustic Fresnel zone plate.

15. The method according to claim 14, wherein, at least one acoustic sensor comprises one of a sparse array of vector sensors, a dense array of vector sensors, and a rotatable array of vector sensors.

16. The method according to claim 14, wherein the at least one acoustic sensor is connected to the acoustic Fresnel zone plate and located in an area around at least one acoustic focal spot, wherein said at least one acoustic focal spot comprises at least one front focal spot and at least one back focal spot, said acoustic Fresnel zone plate comprising a front side and a back side, said at least one acoustic sensor comprising at least one front sensor located on the front side in an area around said at least one front focal spot and at least one back sensor located on the back side in an area around said at least one back focal spot, the method further comprising:

directionally locating the acoustic wave, using the at least one front sensor and the at least one back sensor.

17. The method, according to claim 14, further comprising;

transmitting the acoustic wave from an active acoustic wave source operatively oriented away from said acoustic Fresnel zone plate.

18. The method according to claim 14, further comprising:

transmitting the focused acoustic wave, using a communication link operably communicating with the at least one acoustic sensor.

19. The method comprising:

providing an acoustic Fresnel zone plate located in a surrounding liquid and comprising a compliant frame, a substrate connected to the frame, and an acoustic diffraction grating connected to the substrate, the acoustic diffraction grating comprising one of a plurality of concentric rings and a plurality of concentric islands, the substrate being acoustic-impedance-mismatched with the acoustic diffraction grating, the acoustic Fresnel zone plate comprising at least one focal spot, wherein one of the substrate is acoustic-impedance-mismatched with the surrounding liquid and the acoustic diffraction grating is acoustic-impedance-mismatched with the surrounding liquid, and the substrate is acoustic-impedance-matched with the surrounding liquid and the acoustic diffraction grating is acoustic-impedance-mismatched with the surrounding liquid; and impinging a spherical acoustic wave on the acoustic Fresnel zone plate using a spherical wave acoustic source, thereby generating a planar acoustic wave.

20. The method according to claim 19, farther comprising:

operating the spherical wave acoustic source from a remote site using a communication link.

* * * * *